United States Patent [19]

Crocker

[11] 4,054,210

[45] Oct. 18, 1977

[54] APPARATUS FOR TRANSPORTING AND HANDLING PIPE

[76] Inventor: Roger A. Crocker, Box 37, Wickett, Tex. 79788

[21] Appl. No.: 617,499

[22] Filed: Sept. 29, 1975

[51] Int. Cl.[2] ..... E21B 19/00

[52] U.S. Cl. ..... 214/2.5; 104/183; 175/85; 212/72; 212/77; 214/1 PB

[58] Field of Search ..... 214/1 P, 1 PB, 2.5; 212/72, 76, 77, 80, 93, 87, 94; 175/85; 104/89, 93, 112, 117, 183

[56] References Cited

U.S. PATENT DOCUMENTS

| | | | |
|---|---|---|---|
| 2,751,781 | 6/1956 | McConnell | 214/1 PB |
| 3,655,067 | 4/1972 | White | 214/1 PB |
| 3,700,116 | 10/1972 | Rysti | 214/1 PB |
| 3,774,780 | 11/1973 | Buffington | 214/2.5 |
| 3,825,129 | 7/1974 | Beck | 214/2.5 |

FOREIGN PATENT DOCUMENTS

| | | | |
|---|---|---|---|
| 644,775 | 7/1962 | Canada | 214/77 R |

*Primary Examiner*—Robert J. Spar
*Assistant Examiner*—George F. Abraham
*Attorney, Agent, or Firm*—Pravel, Wilson & Gambrell

[57] ABSTRACT

Pipe handling apparatus for transporting pipe in a pipe carrier between a pipe rack and a derrick floor wherein the pipe carrier is supported by a first cable and is manipulated between the pipe rack and the derrick floor by a second cable which is operably connected to a lateral displacement means mounted with the pipe carrier for lateral displacement of the pipe carrier and the pipe therein as the pipe carrier nears the derrick floor thereby to position the pipe for unloading at the derrick floor without detrimental contact of the pipe with any object to accomplish such lateral displacement.

10 Claims, 7 Drawing Figures

4
4
58
54
52
50
56
42
40b
C
70
70b
50
70
44
64b
68
T
64
L
64a
60b
32
62
60
60a
C
40b
42
44
26
28
40
40a
56
20
36
30
38
18
16
S
C
S
22
24
C
E
32
L
22
24
P
R
T
12
34
14
82
80
84
10

APPARATUS FOR TRANSPORTING AND HANDLING PIPE

BACKGROUND OF THE INVENTION

1. Field of Invention

The present invention relates to apparatus for transporting pipe between a pipe rack and an elevated platform, such as an oil derrick floor.

2. Description of the Prior Art

In the past, pipe has been moved from a pipe rack located on the ground to the floor of a derrick platform by hauling the pipe up an inclined ramp with the aid of a pickup elevator situated in an elevated position above the derrick floor, as exemplified by U.S. Pat. No. 3,532,229; by using a mechanized elevator located adjacent to the derrick platform to elevate the pipe from the pipe rack to the level of the derrick platform as exemplified by U.S. Pat. No. 2,900,091; and by manipulating an elevated pipe-carrying cable so that it is raised and lowered for the handling of the pipe between the pipe rack and the derrick floor, as exemplified by U.S. Pat. No. 3,825,129 and 3,774,780. Other known prior art includes U.S. Pat. Nos. 2,789,707; 2,900,091; 3,494,483; and 3,810,553.

So far as is known, when the elevated cable apparatus has been used, the pipe has simply been "banged" into a deflector plate on the derrick platform for deflecting the pipe to one side of an upright member supporting the cable at the derrick.

The use of such deflector plate is subject to producing damage to the pipe upon each deflection, which damage or potential damage is avoided by the present invention.

SUMMARY OF THE INVENTION

Briefly, the present invention provides a new and improved apparatus for transporting pipe between a pipe rack and an elevated platform, such as an oil derrick floor. The apparatus includes a pipe carrier for transporting pipe therein supported by a movable support means which is mounted on an elevated first cable and movable longitudinally along the first cable. The pipe carrier is moved between the pipe rack and the derrick floor by a second cable mounted to a lateral displacement means which, in the preferred embodiment, is mounted with the pipe carrier. The lateral displacement means laterally displaces the pipe carrier and the pipe therein as the pipe approaches the area in proximity to the derrick floor. This lateral displacement of the pipe carrier prevents the pipe carrier or the pipe therein from hitting objects on the derrick platform and positions the pipe for unloading without detrimental contact of the pipe with any object to accomplish such lateral displacement.

It is an object of the present invention to provide a new and improved apparatus for transporting pipe between a pipe rack and a derrick platform.

It is a further object of the present invention to provide a new and improved pipe transporting apparatus having means to laterally displace the pipe to avoid hitting any object with the pipe at the point of unloading of the pipe at the derrick platform.

DESCRIPTION OF THE PREFERRED EMBODIMENT

Figures 1, 2, 3:
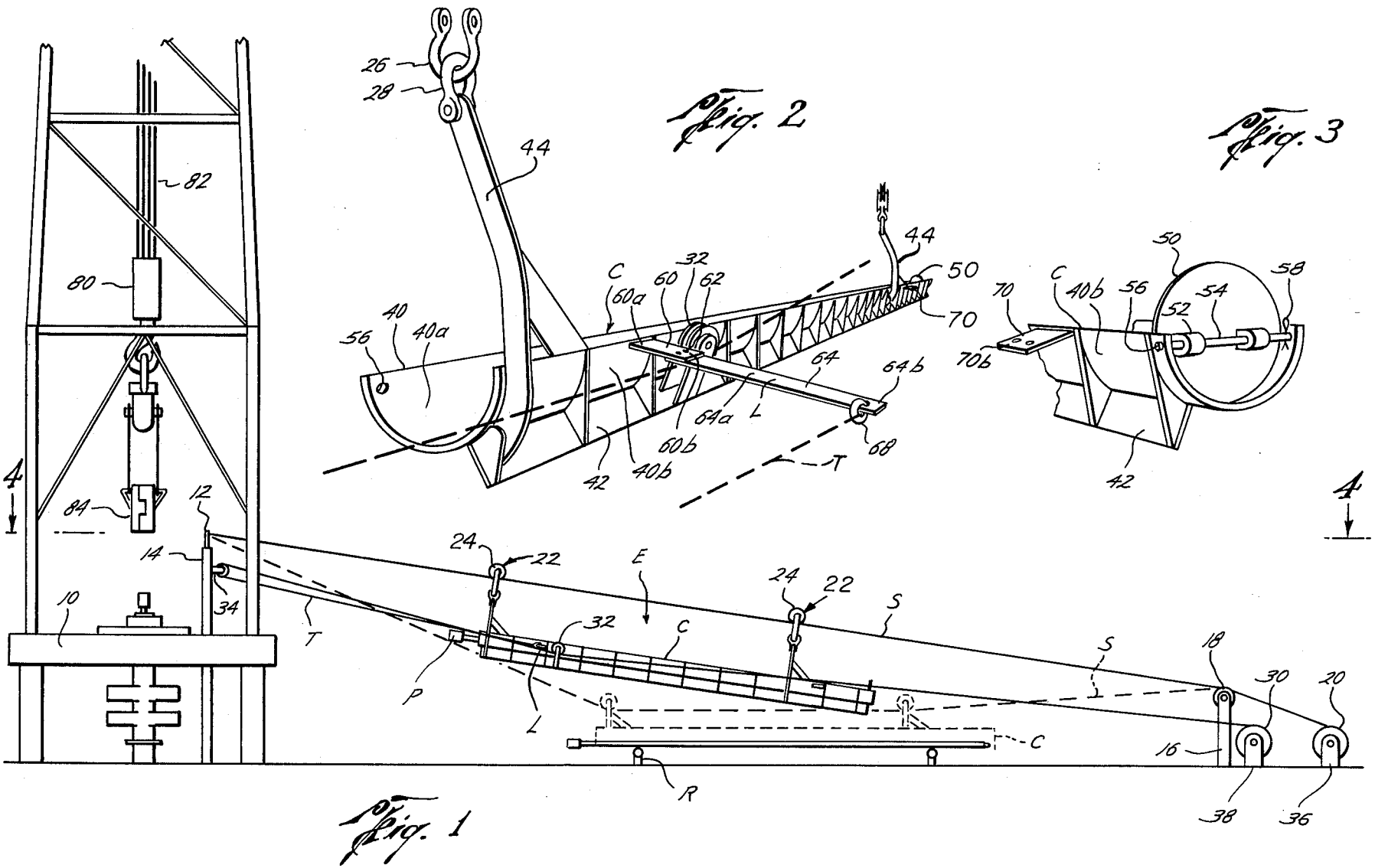
FIG. 1 is an elevation of the pipe transporting apparatus of this invention in its operating position for conveying pipe from a horizontal rack to a position adjacent the derrick floor, with an alternate position for loading pipe from the pipe rack being shown with dash lines.
FIG. 2 is a perspective view of the pipe carrier of FIG. 1.
FIG. 3 is a fragmentary perspective view of an end of the pipe carrier shown in FIG. 2, with parts broken away, showing a removable end plate.

In the drawings, the letter E designates generally the apparatus of the present invention for transporting pipe P between a pipe rack R and an elevated platform 10 of a drilling rig or derrick D. The drilling rig D is typically of the conventional type and includes an elevated platform 10 having a conventional "mousehole" formed therein (not shown) through which a length of pipe 14 extends. The length of pipe is typically termed a "mousehole casing".

The pipe rack R which provides a storage area for pipes, generally is located below and remote from the derrick D and is also of the conventional type.

The apparatus E of the present invention (FIG. 1) includes a first or support cable S which extends between a first upright member 12 extending out of a part of the pipe 14 located above the derrick platform 10 and a second upright member 16 spaced apart from the derrick D so that the cable S overhangs a portion of the pipe rack R. A pipe carrier C for carrying pipe P between the derrick platform 10 and the pipe rack R is normally suspended from and movable longitudinally along the support cable S. A second or transporting and shifting cable T attached to a lateral support member L mounted with the pipe carrier C is used to move the pipe carrier C longitudinally along the support cable S. A transferring apparatus A transfers pipe P from the pipe rack R to the pipe carrier C when the pipe carrier C is in the alternate pick-up position shown in dashed lines in FIG. 1. This alternate pick-up position will be more fully described below.

Considering the apparatus E more in detail, one end of the support cable S is attached to the upper end of the first upright member 12 which extends out of the pipe 14 situated on the derrick D. Support cable S extends from the first support member 12 through a pulley 18 mounted to the upper end of the second support member 16 to a suitable winching mechanism 20. For anchoring, the winching mechanism 20 may be mounted on the bed of a truck (not shown) or any other suitable base 36. The winching mechanism is capable of tensioning the support cable S sufficiently to normally dispose the support cable S in a substantially straight line between the upright members 12 and 16 when the pipe carrier C is suspended therefrom.

Two support assemblies 22 mounted with the support cable S have pulleys or sheaves 24 which travel along the support cable S thereby providing longitudinal movement of the assemblies 22 along the support cable S. It should be noted that any suitable support means which allows longitudinal movement along the support cable S may be used instead of assemblies 22. In addition, a different number of movable support means other than the two assemblies 22 may be used for supporting the pipe carrier C without departing from the present invention.

Each support assembly 22 includes a clevis 26 or other suitable coupling device (FIG. 2) which connects to a clevis 28 or other suitable coupling device attached to the pipe carrier C. The support assemblies 22 thereby support the pipe carrier C situated beneath the support cable S while also allowing movement of the pipe carrier C longitudinally along a substantially straight line between the upright members 12 and 16.

Figure 4:
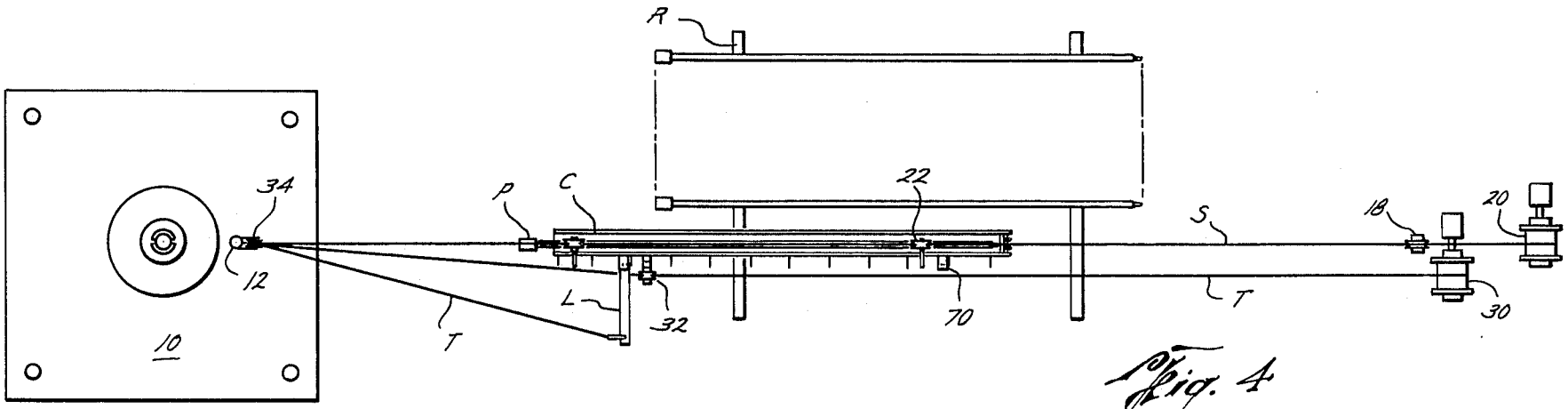
FIG. 4 is a plan view of the pipe transporting apparatus, showing the pipe carrier's normal orientation as it is moved along the cable.
Figure 5:
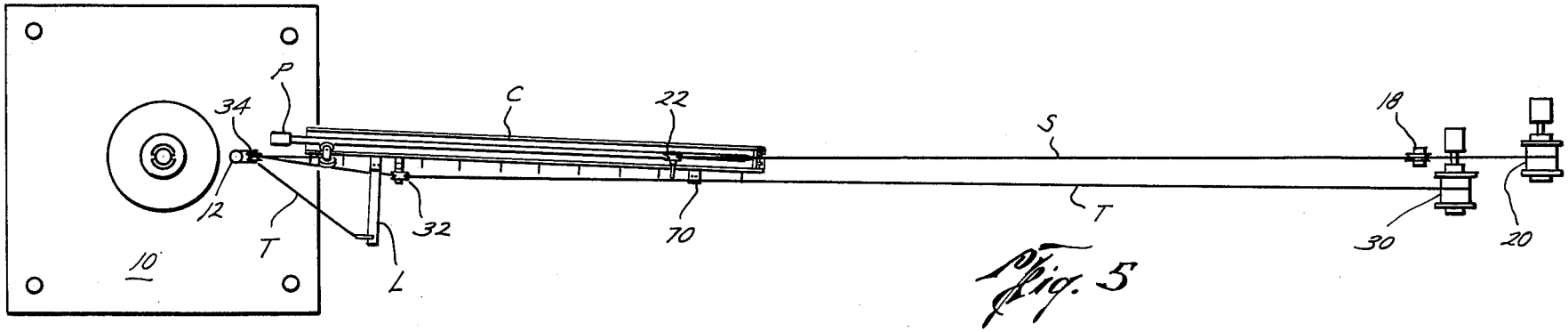
FIG. 5 is a plan view of the pipe transporting apparatus, showing the carrier's lateral displacement as it reaches the area in proximity to the derrick floor.

The cable T is operably wound on a winch or winching mechanism 30, typically mounted to the bed of a truck (not shown) or any other suitable base 38, and it extends longitudinally therefrom through a guide pulley 32, then through a pulley block 34 mounted to the upright support pipe 14 supporting the first upright member 12, and is fastened to a lateral displacement member L mounted with the pipe carrier C, as more fully described hereinafter. The guide pulley 32 or other suitable guiding means is preferably mounted with the pipe carrier C to provide a guide for the movement of the cable T beween the winching mechanism 30 and the pulley block 34 mounted to the pipe 14 of the derrick D. In the preferred embodiment, the pulley 32 is mounted adjacent to the lateral displacement member L (FIGS. 4 and 5). The guide pulley 32 avoids interference of the cable T with the pipe carrier C as the pipe carrier C moves longitudinally along the support cable S. The longitudinal movement of the pipe carrier C between the pipe rack R and the derrick D is provided by operating the winch 30 in the known manner.

In the preferred embodiment, the pipe carrier C (FIG. 2) includes a pipe-carrying member 40, typically of a semi-cyclindrical shape, formed from steel or other suitable material. The pipe-carrying member 40 includes an interior concave surface **40*a* which defines an enclosure suitable for carrying pipe P therein. It should be noted, however, that the pipe-carrying member 40** need not be semi-cyclindrical in order to provide a suitable carrying surface.

A loading rib 42 formed preferably from steel or other suitable material extends the length of the pipe-carrying member 40 and is mounted with the convex exterior surface **40*b* of the pipe-carrying member 40. When the pipe carrier C is lowered onto the transferring apparatus A in a manner to be described below, the rib 42 permits the pipe-carrying member 40 to rotate to a second position wherein the concave enclosure surface 40*a* faces laterally from the longitudinally straight line between the upright members 12 and 16 rather than upwardly thereby allowing pipe P to be rolled into the pipe-carrying member 40.**

The pipe carrier C also includes an arm 44 of steel or other suitable material mounted at each end of the pipe-carrying member 40, each of which extends upwardly from the pipe-carrying body 40 to any suitable connector such as coupled clevises 26 and 28 which connects the arms 44 to the support assemblies 22. The pipe carrier is thus connected to the assemblies 22 so that the carrier C may be moved laterally relative to the longitudinal substantially straight line between the upright members 12 and 16 when a lateral force is exerted thereon, as will be more evident hereinafter.

A removable end plate 50 (FIG. 3) may be placed in either end of the semi-cylindrical shaped pipe-carrying member 40 and attached thereto by any suitable means such as a pin 54 positioned through axially aligned holes 56 formed in both ends of the pipe-carrying member 40 and holes in lugs 52 on the end plate 50. A cotter key 58 passes through an opening in pin 54 to prevent the pin 54 from moving outwardly from its supporting position. The end plate 50 prevents a pipe P mounted in the pipe-carrying member 40 from slipping out of the pipe carrier C as it moves along the cable S in a manner to be described below. It should be noted that end plate 50 is positioned at the lower end of the pipe-carrying member 40, thereby leaving the upper end of the pipe-carrying member 40 open without an end plate 50. The end plate 50 may be removed from one end and placed in the other end to permit the pipe carrier C to be used in a reversed position, thereby allowing loading and unloading of pipe P from a lateral direction opposite the first loading orientation shown in FIG. 2, as will be more fully explained.

The lateral displacement member L is mounted to the pipe carrier C at a position near one end of the pipe carrier C by welding or other suitable mounting means. The lateral displacement member L includes a beam or projecting member 60, formed of metal or other suitable material, which has an end **60*a* mounted with the pipe-carrying member 40 of the pipe carrier C. An end 60*b* of projecting member 60 has openings 62 formed therein for reasons to be described below. An extension member 64 has an inner end 64*a* with openings adapted to be aligned with the openings 62 of the projecting member 60 to receive releasable connecting bolts or other suitable connecting means to thereby releasably connect the extension member 64 to the end 60*b* of the projecting member 60. A hook 68 is preferably mounted to the outer end 64*b* of the extension member 64 for attaching the cable T thereto. Thus, the lateral displacement member L is preferably formed in two separable sections for a purpose to be hereinafter described, with its inner end 60*a* mounted with the pipe-carrying member 40 of the pipe carrier C and its outer end 64*b* connected to the cable T. The lateral displacement member L laterally displaces the pipe carrier C relative to the longitudinal substantially straight line between the two upright members 12 and 16 as the pipe carrier C approaches the area in proximity to the first upright member 12,** as explained below.

A second beam or projecting member 70, preferably formed in a like manner to the projecting member 60, is welded or otherwise mounted on the same side, but near the opposite end of the pipe carrier C from the projecting member 60.

The extension member 64 may be alternately mounted to the projecting member 70 rather than to projecting member 60 for providing a second lateral displacement member L for laterally displacing the pipe carrier C whenever the pipe carrier is connected to the assemblies 22 in a reversed loading orientation. In this reversed orientation, the arms 44 of the pipe carrier C are on the right-hand side of the carrier as viewed in FIGS. 4 and 5 looking toward the derrick D. This reversed orientation of the pipe carrier may be used to load pipe P into the pipe carrier C from a pipe rack R situated to the left-hand side of the pipe carrier C (as viewed in FIg. 4 looking towards the derrick floor from the winch 30).

Further, the hook 68 to which the cable T is attached may be mounted on the end 60*b* of the projecting member 60 or the end 70*b* of the member 70 rather than on the outer end 64*b* of the extension member 64. This reduces the distance between the ends of the lateral displacement member L and thereby reduces the amount of displacement that occurs when the pipe carrier C approaches the area in proximity to the first upright member 12 on the derrick D. In many instances, the shorter displacement distance will be sufficient for preventing the pipe-carrying member 40 from abutting the first upright member 12.

Figure 7:
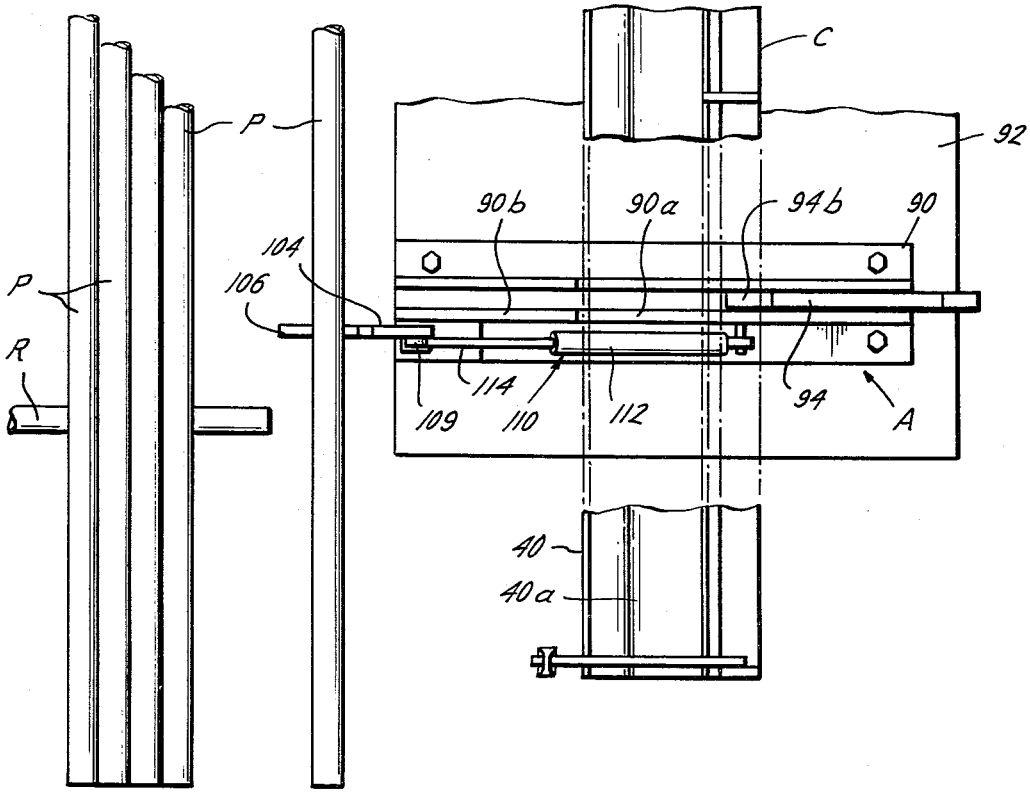
FIG. 7 is a plan view of the transferring apparatus of FIG. 6.

A transferring apparatus A (FIG. 7) consisting of two units (only one of which is illustrated in FIG. 7 since the other unit is a duplicate) is positioned adjacent the pipe rack R with one unit at each end thereof and beneath the support cable S for transferring pipe P from the pipe rack R to the pipe carrier C when the pipe carrier C is in the alternate pick-up position shown in phantom in FIG. 1. It should be noted that pipe P may be loaded from the pipe rack R into the pipe carrier C manually or by other suitable equipment. The present apparatus A, however, performs the loading direction more efficiently and with less danger to workers than previous equipment, as far as known. In addition, a different number of transferring apparatus other than the two apparatus A may be used without departing from the present invention.

Each unit of the apparatus A includes a support base 90 (FIG. 6) for supporting the pipe carrier C during transfer of the pipe P from the pipe rack R to the pipe carrier. The support base 90 may be formed from metal or other suitable material. Preferably, the support bases 90 of both units of the apparatus A are mounted on a common platform 92 extending the length of the pipe rack R to form a level support for the bases 90. The bases 90, in turn, provide a level support for the pipe carrier C when positioned thereon for picking up and discharging pipe therefrom.

Each unit of the apparatus A has a carrier-rotating member or upright angulated member 94 mounted on the base 90 by welding or other suitable means. The carrier-rotating member 94 includes a guiding surface 94*a* which extends upwardly from the base 90 at an obtuse angle for guiding the pipe carrier C as it is lowered in a manner to be described hereinafter. The guiding surface 94*a* guides the pipe carrier C as it is lowered until the loading rib 42 of the pipe carrier C rests on an abutment 94*b* of the carrier-rotating member 94. The abutment 94*b* prevents further movement of the loading rib 42 while allowing the pipe-carrying member 40 of the pipe carrier C to rotate or turn in a counterclockewise direction (as viewed in FIG. 6) until it abuts a surface 90*a* of the base 90. The surface 90*a* is lower than a surface 90*b* so as to define a shallow recess suitable for positioning the pipe-carrying member 40 into a second position wherein the concave enclosure surface 40*a* of the pipe-carrying member 40 faces substantially laterally from the longitudinal straight line between the upright members 12 and 16 of the pipe transporting apparatus rather than upwardly. In this second position, part of the surface 40*a* is level with or beneath the surface 90*b* of the support base 90 over which pipe can be easily rolled into the pipe-carrying member 40 of the pipe carrier C. To facilitate such rolling of the pipe P, the surface 90*b* may be inclined as shown.

An arm 104 having a hook or curved end 106 is mounted with the support base 90 by a pin 108 or other suitable pivotal support. The arm 104 may be formed from steel or other suitable material which provides the structural strength required for supporting a pipe P. The pin 108 allows the arm 104 to pivot from a first position wherein the curved end 106 of the arm 104 is lower than the pipe P when the pipe is on the pipe rack R to a second position shown in phantom in FIG. 6 wherein the curved end 106 is at a higher elevation than the support base 90.

A fluid-actuated system 110 or other suitable means is used to pivotally rotate the arm 104 between the first position and the second position. Preferably, the fluid-actuated system 110 is a hydraulic system of the conventional type which has a cylinder 112 mounted to the support base 90 beneath the pipe-rotating member 94 by means of a pivot pin 113. A piston rod 114 with a piston in the cylinder 112 is extended from and retracted into the cylinder 112 by means of hydraulic fluid in the known manner. The outer end 114*a* of the rod 114 is pivotally connected by a pivot pin 109 to the arm 104 above the pivot pin 108. The actuating fluid for moving the piston (not visible) in the cylinder 112 is transferred to the cylinder 112 through a suitable conduit (not shown) from a position adjacent to or remote from the apparatus A. A control station may be set up at a remote position for controlling flow of fluid to and from the fluid-actuated system 110 for operating same as hereinafter described.

When the piston rod 114 is moved outwardly from the cylinder 112 by fluid pressure, the arm 104 is moved towards and ultimately into the first position (solid lines) wherein one length of pipe P may be transferred from the pipe rack R into the hook or curved end 160. After the pipe P is thus received, the piston rod 114 is retracted to the position shown in phantom in FIG. 6, causing the arm 104 to pivot about the pin 108 so as to move the hook 106 to the second position (dash lines) with sufficient force to thrust the pipe P from the hook 106 onto the surface 90*b* to cause the pipe P to roll into the pipe-carrying member 40 of the pipe carrier C without any manual manipulation of the pipe normally being required.

OPERATION

In the operation of the apparatus of this invention with the carrier C positioned on the support cable S with the arms 44 on the left-hand side as viewed in FIGS. 4 and 5 looking towards the derrick floor from the winch 30, the cable T moves the pipe carrier C back and forth longitudinally between the first upright member 12 located on the derrick D and the pipe rack R, as shown in FIG. 4.

Figure 6:
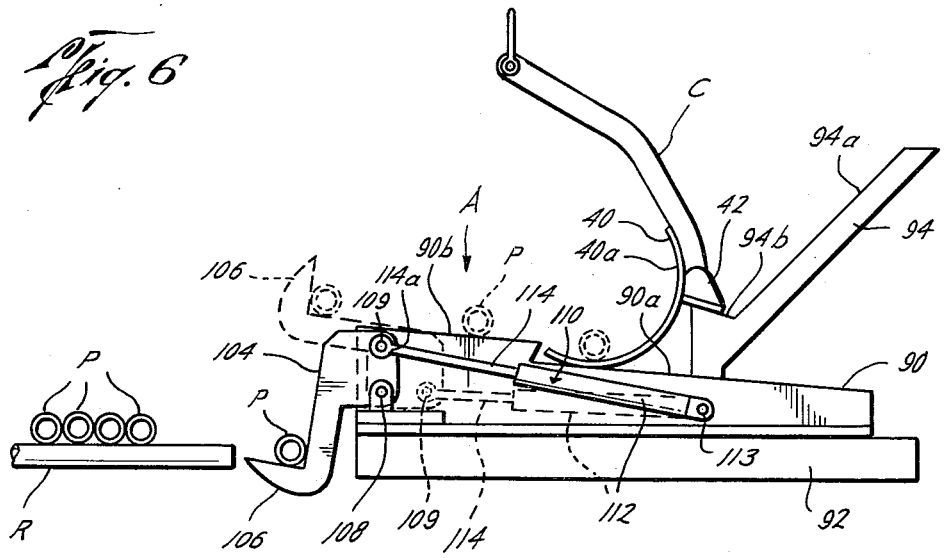
FIG. 6 is an elevation view of the apparatus for transferring pipe from the pipe rack to the pipe carrier in its operating position adjacent the pipe rack.

For loading pipe P onto the pipe carrier C from the pipe rack and vice versa, the pipe carrier C suspended from the support cable S is first positioned directly above the pipe rack R with the aid of the cable T. Next, the tension provided by the winching mechanism 20 for normally disposing the support cable S in the longitudinal substantially straight line between the upright member 12 and 16 is reduced, which allows the cable S to be slacked off to the alternate position shown in dash lines in FIG. 1. With the support cable S in such pick-up position, the pipe carrier C rests on the apparatus A as shown in FIGS. 6 and 7. A pipe P is then loaded onto the pipe carrier C, preferably by means of the transferring apparatus A, as previously described.

After loading the pipe P into the pipe carrier C, the winching mechanism 20 is operated to increase the tension on the support cable S until the cable S is again taut and disposed in a substantially straight line with a minimum of vertical sag therein between the upright members 12 and 16. The winching mechanism 30 is then operated to wind in the cable T thereby pulling the pipe carrier C and the pipe P therein toward the derrick D. Prior to the carrier C reaching a position in proximity to the derrick D, the cable T does not exert a sufficient lateral force through the lateral displacement member L to the pipe-carrying member 40 of the pipe carrier C to laterally displace the pipe carrier C relative to the longitudinal substantially straight line between the upright members 12 and 16.

However, as the pipe carrier C approaches the area in proximity to the first upright member 12 (FIG. 5), the cable T forces the end **64*b* of the extension member 64 laterally substantially into alignment with the first upright member 12. To bring the end 64*b* into such substantial alignment with the first upright member 12, the lateral displacement member L is displaced laterally from the longitudinal substantially straight line between the upright members 12 and 16. The displacement of the lateral displacement member L in turn laterally displaces the pipe-carrying member 40 of the pipe carrier C laterally so that the pipe P in the pipe-carrying member 40 does not abut the first upright member 12 as it reaches the area in proximity to the first upright member 12.**

Such lateral displacement of the pipe-carrying member 40 allows a pipe elevator 84, suspended from a traveling block 80 by cable 82, to be lowered by a hoisting mechanism (not shown) and fitted about the end of the pipe P extending from the end of the pipe carrier C (FIG. 1) for unloading the pipe P from the pipe carrier. Alternately, a pipe that has been recently drawn from the well by the pipe elevator 84 may be loaded onto the laterally displaced pipe carrier C more easily for transporting the pipe from the derrick floor 10 of the oil derrick D to the pipe rack R.

The foregoing disclosure and description of the invention are illustrative and explanatory thereof, and various changes in the size, shape, and materials as well as in the details of the illustrated construction may be made without departing from the spirit of the invention.

I claim:

1. An apparatus for transporting pipe from a pipe rack to a derrick platform, and for transporting pipe from the derrick platform to a pipe rack, comprising:

a. a first upright member;

b. a second upright member spaced longitudinally apart from said first upright member;

c. a first cable extending between said first and second upright member and normally disposed in a longitudinal substantially straight line between said upright members;

d. support means mounted on said first cable for movement longitudinally along said first cable;

e. a pipe carrier supported by said support means for transporting pipe therein;

f. a second cable coacting with said carrier for moving said pipe carrier longitudinally relative to said first cable; and g. lateral displacement means coacting with said second cable for laterally displacing said pipe carrier relative to said longitudinally substantially straight line between said upright members as said pipe carrier approaches the area in proximity to said first upright member.

2. The structure of claim 1, wherein:

said lateral displacement means is mounted on said pipe carrier.

3. The structure of claim 2, wherein said lateral displacement means comprises:

a. a projecting member extending laterally from the longitudinal axis of said pipe carrier.

4. The structure of claim 3, wherein:

said projecting member includes an end spaced laterally from said pipe carrier for mounting with said second cable.

5. The structure of claim 4, further including:

a. a pulley mounted adjacent said first upright member;

b. power means for pulling said second cable to move said pipe carrier in a direction towards said derrick floor; and c. said second cable extends from said power means into operative engagement with said pulley and to said laterally spaced end of said projecting member, whereby pulling said second cable brings said laterally spaced end of said projecting member into alignment with said first upright member when said pipe carrier approaches the area in proximity to said first upright member and thereby causes said projecting member to displace said pipe carrier laterally from the first upright member.

6. The structure of claim 5, wherein said lateral displacement means further includes:

guide means guiding said second cable in the area about said pipe carrier.

7. The structure of claim 3, wherein:

a. said projecting member has an end portion spaced laterally from said pipe carrier; and b. said lateral displacement means further comprises:

1. an extension member having a first end portion for mounting on said laterally spaced end portion of said projecting member and a second end portion for securing to said second cable, thereby providing a greater distance between said pipe carrier and said second cable mounted with said lateral displacement means, the magnitude of the lateral displacement of said pipe carrier being proportional to the distance between said pipe carrier and said second cable.

8. The structure of claim 7, further including:

a. a pulley mounted with said first upright member;

b. power means for pulling said second cable to move said pipe carrier in a direction toward said derrick floor; and c. said second cable extends from said power means into operative engagement with said pulley and to said second end portion of said extension member, whereby pulling said second cable brings said second end portion of said extension member into alignment with said first upright member when said pipe carrier approaches the area in proximity to said first upright member and thereby causes said lateral displacement means to displace said pipe carrier laterally from the first upright member.

9. The structure of claim 2, wherein said lateral displacement means comprises:

a. first lateral displacement means positioned near one end of said pipe carrier and providing a first loading and unloading orientation when used; and b. second lateral displacement means positioned near a second end of said pipe carrier for alternately providing a second loading and unloading orientation when said pipe carrier is used in a reversed position; and c. said second cable is connected to said first lateral displacement means for laterally displacing said pipe carrier.

10. The structure of claim 1, further including apparatus for transferring a pipe from the pipe rack to said pipe carrier, said transferring apparatus comprising:

a. support base means for supporting said pipe carrier during transfer of the pipe from the pipe rack to the pipe carrier;

b. arm means having a curved end for engaging the pipe;

c. means mounting said arm means for pivotal movement from a first position wherein said curved end of said arm means is lower than the pipe when the pipe is on the pipe rack to a second position wherein said curved end of said arm means is at a higher elevation than said base support means;

d. means for pivotally rotating said arm means from the first position to the second position for transferring the pipe from the pipe rack into the pipe carrier by such pivotal movement of said arm means.

* * * * *